US011180345B2

(12) United States Patent
Madureira De Almeida

(10) Patent No.: US 11,180,345 B2
(45) Date of Patent: Nov. 23, 2021

(54) FASTENING MODULE FOR FASTENING ELEVATOR RAILS

(71) Applicant: Inventio AG, Hergiswil (CH)

(72) Inventor: Rogério Madureira De Almeida, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 642 days.

(21) Appl. No.: 16/063,403

(22) PCT Filed: Dec. 15, 2016

(86) PCT No.: PCT/EP2016/081306
§ 371 (c)(1),
(2) Date: Jun. 18, 2018

(87) PCT Pub. No.: WO2017/103017
PCT Pub. Date: Jun. 22, 2017

(65) Prior Publication Data

US 2018/0370766 A1 Dec. 27, 2018

(30) Foreign Application Priority Data

Dec. 17, 2015 (EP) ..... 15200954

(51) Int. Cl.
*B66B 7/02* (2006.01)

(52) U.S. Cl.
CPC ..... *B66B 7/024* (2013.01)

(58) Field of Classification Search
CPC ... B66B 7/024; E01B 9/28; E01B 9/32; E01B 9/46; E01B 9/48; E01B 9/50
See application file for complete search history.

(56) References Cited

U.S. PATENT DOCUMENTS 620,912 A * 3/1899 Graham ..... E01B 9/32 238/347
1,505,345 A 8/1924 Heptner
1,925,867 A 9/1933 Dunlop
(Continued)

FOREIGN PATENT DOCUMENTS

CH 484826 A 6/1969
CN 101146732 A 3/2008
(Continued)

*Primary Examiner* — Minh Truong
(74) *Attorney, Agent, or Firm* — William J. Clemens; Shumaker, Loop & Kendrick, LLP

(57) ABSTRACT

A fastening module, for fastening a rail foot of an elevator rail to a fastening plane, includes a first fastening device fastened to the fastening plane and holding a first side of the rail foot, and a second fastening device fastened to the fastening plane and holding a second side of the rail foot. The second fastening device can be moved at least substantially in parallel with the fastening plane. At least one element of the second fastening device, which interacts with a top side of the rail foot facing away from the fastening plane, can be rotated about an axis of rotation of the second fastening device perpendicularly to the fastening plane over the top side of the rail foot from laterally outside of the rail foot. A method for fastening a rail foot utilizes a plurality of the fastening modules to fasten elevator rails of an elevator system.

16 Claims, 5 Drawing Sheets

(56) References Cited

U.S. PATENT DOCUMENTS

| | | | | | |
|---|---|---|---|---|---|
| 2,451,414 | A * | 10/1948 | Jacob | E01B 9/28 | 238/349 |
| 2,848,077 | A * | 8/1958 | Tofanelli | B66B 7/02 | 187/408 |
| 3,982,692 | A | 9/1976 | Feyrer et al. | | |
| 4,431,087 | A * | 2/1984 | Karol | B66B 7/024 | 187/408 |
| 4,572,431 | A * | 2/1986 | Arato | E01B 9/46 | 238/20 |
| 4,577,729 | A * | 3/1986 | Karol | B66B 7/024 | 187/408 |
| 4,802,624 | A * | 2/1989 | Marchant | E01B 9/66 | 238/317 |
| 4,844,338 | A * | 7/1989 | Bucksbee | B61L 1/00 | 238/283 |
| 6,371,249 | B1 * | 4/2002 | Schops | B66B 7/024 | 187/408 |
| 6,830,133 | B2 | 12/2004 | Sneed | | |
| 9,242,835 | B2 * | 1/2016 | Bjorni | B66B 7/023 | |
| 2012/0133164 | A1 * | 5/2012 | Gamboa | B66B 7/024 | 294/119.1 |
| 2017/0297867 | A1 * | 10/2017 | Fauconnet | B66B 7/023 | |
| 2018/0362299 | A1 * | 12/2018 | Polinski | B66B 7/021 | |

FOREIGN PATENT DOCUMENTS

| | | | |
|---|---|---|---|
| DE | 1139254 | B | 1/1957 |
| EP | 0448839 | A1 | 10/1991 |
| EP | 2174902 | A1 | 4/2010 |
| ES | 2421083 | A1 | 2/2012 |
| ES | 2492791 | A1 | 8/2013 |
| ES | 2557505 | B1 † | 1/2016 |
| FR | 2996216 | A1 | 4/2014 |
| JP | 2015054754 | A | 3/2015 |

* cited by examiner
† cited by third party

FASTENING MODULE FOR FASTENING ELEVATOR RAILS

FIELD

The invention relates to a fastening module used for fastening a rail foot of an elevator rail to a fastening plane, and to an elevator system comprising elevator rails that are mounted in an elevator shaft or the like using fastening modules of this type. Furthermore, the invention relates to a method for fastening a rail foot of an elevator rail, carried out using fastening modules of this type. Specifically, the invention relates to the field of elevator systems that are installed in tall buildings and extend over a large number of floors.

BACKGROUND

DE-AS 1 139 254 relates to a guide-rail fastening apparatus for attaching guide rails of elevators to a supporting structure. This is based on the knowledge that it is advantageous for relative upward movements of the guide-rail portions to be made possible when buildings are settling. To make it easier for the building and the guide rail to move vertically relative to one another, fastening holes in the form of slots are made in a support plate in order for bolts for guide-rail clamps to be inserted therethrough, which clamps are removed from the adjacent ridge wall in an upward direction by the longitudinal axes thereof, guide-rail clamps being in contact with flanges of the guide rail in a resilient manner. If the length of the guide rail increases due to thermal expansion, the forces transmitted to the bolts move the slidably aligned rail-fastening apparatus upwards, in order to reduce the friction between the guide-rail clamps and the guide rail, and this makes it easier for the guide rail to move vertically upwards relative to the guide-rail clamps.

The guide-rail fastening apparatus known from DE-AS 1 139 254 has the drawback that a direction-dependent change in the friction occurs. Specifically, if the opposite relative movement conversely occurs, for example due to temperature-related contraction of the guide rail, the bolts are moved downwards into the slots, and this increases the friction between the guide-rail clamps and the guide rail, and prevents a relative vertical movement between the fastening apparatus and the rail. In addition, each movement of the bolt in the slot also leads to a change in the holding force or play in the guide rail on the fastening apparatus, which is undesired.

CH-PS 484 826 discloses a fastening apparatus for guide rails of elevators. This fastening apparatus is based on the knowledge that, when fastening guide rails for elevators, it needs to be taken into account that, in the event of changes in temperature, the length of the guide rails changes, and that the brickwork of the shaft may contract over time. Therefore, longitudinal adjustment is permitted between the guide rails and the brickwork of the shaft. The proposed fastening apparatus sufficiently holds the guide rails in the horizontal direction, and does not tightly clamp said rail in the vertical direction. For this purpose, a rail clamp is arranged on either side of the guide rail. A rail clamp consists of two circular disks of different diameters that lie coaxially on top of one another and transition into one another in a conical manner. In order to set the play, a plurality of spacer disks are inserted between the support plate and the rail clamp.

In the fastening apparatus known from CH-PS 484 826, it is necessary for it to be assembled from a plurality of parts, with the technician having to set the play by means of spacer disks.

U.S. Pat. No. 3,982,692 discloses fastening means that are used to fasten the sides of an elevator rail having a T-shaped profile to a support, this taking place such that a relative movement of the elevator rail is possible, for example in order to compensate for the building settling. Here, lateral movements are prevented, while limited movement of the elevator rail away from the support against the preload force of a spring tab is made possible.

The fastening known from U.S. Pat. No. 3,982,692 has the drawback that the adjusting movements, which are limited, but possible, allow torsion of the elevator rail along its longitudinal axis, and this results in corresponding curvature of the guide tracks provided on the elevator rail when, for example, transverse forces are transmitted from the elevator car or the counterweight to the elevator rail during operation. This is generally undesired.

EP 0 448 839 A1 discloses a fastening apparatus for the guide rails of elevators. In the known fastening apparatus, a change to a preload force of the rail clamps can be achieved by a semi-circular profile that is used as lining for the guide rail having different thicknesses. To do this, it is however necessary to determine which semi-circular profile is required and needs to be delivered before the elevator system is installed.

U.S. Pat. No. 6,371,249 B1 discloses a rail clamp in which a clamping bracket guided in a slot arranged on the side of the guide rail can be pivoted from the outside by means of a foot of the guide rail, and whereby the guide rails can be clamped on either side. In order to optimize mounting, the lateral slots are arranged at an angle of 45°. The laterally arranged slots extending at an angle require a lot of space and weaken a cross section of a corresponding wall plate.

EP 2174902 A1 discloses another rail clamp that is suitable for interconnecting a plurality of rails. Here, a rail clamp is moved laterally in a slot made to the side of the guide rail. The lateral holding force for holding the rail is provided solely by a frictional force of the fastening parts in this case.

The known configurations are unsatisfactory. They for example require a lot of space, they insufficiently transmit required forces or they need to be assembled on site, which is complex, or they need to be disassembled at least in part in order to insert the elevator rail.

In an elevator system installed in a building, the elevator rails can be fastened to a building wall directly or indirectly. The elevator rails, used for example as guide rails for the elevator car or counterweight, may extend over the entire travel path of the elevator in this case, which often approximately corresponds to the height of the building. In this case, the elevator rails need to be fastened securely enough within the building that they can reliably absorb guide forces. The height of the building may change over time, however. The building shrinks because it dries out and settles, for example. The temperatures of the building and solar radiation may also cause the height of the building to change. The elevator rails can thus move relative to the building, it in particular being possible for the height of the building to reduce relative to the elevator rails. In order to prevent deformation to rail portions in this case, fastening points on the elevator rails are designed such that length compensation is made possible, but at the same time such that there is sufficient fastening to absorb guide forces.

SUMMARY

One problem addressed by the invention is to provide a fastening module for an elevator rail, an elevator system comprising a plurality of fastening modules, and a method for fastening an elevator rail which all have an improved configuration. Specifically, one problem addressed by the invention is to provide a fastening module for an elevator rail, an elevator system comprising a plurality of fastening modules, and a method for fastening an elevator rail which allow improved fastening, which makes it possible for the elevator rail to carry out a relative movement along the extension thereof and also prevents movement or rotation in an imaginary plane perpendicular to the extension, and allows a technician to carry out assembly in a simple and compact manner.

Solutions and proposals for a corresponding fastening module, a corresponding elevator system, and a corresponding method are hereinafter presented that solve at least parts of at least one of the problems posed. In addition, advantageous additional or alternative developments and embodiments are specified.

In one solution, the fastening module, which is used to fasten a rail foot of an elevator rail to a fastening plane, can be designed to comprise a first fastening device, which, when assembled, is fastened to the fastening plane and is used to hold a first side of the rail foot, and a second fastening device, which, when assembled, is fastened to the fastening plane and is used to hold a second side of the rail foot, it being possible for the second fastening device to be moved at least substantially in parallel with the fastening plane and it being possible for at least one element of the second fastening device, which element, when assembled, interacts with a top side of the rail foot facing away from the fastening plane, to be rotated about an axis of rotation of the second fastening device at least substantially perpendicularly to the fastening plane, over the top side of the rail foot from laterally outside of the rail foot.

The elevator rail itself is not part of the fastening module in this case. The fastening module can be preassembled at a manufacturing plant, and produced and distributed as a unit. When assembling the elevator system, a plurality of fastening modules are used in order to mount elevator rails in an elevator shaft. A single elevator rail, which may be an integral portion of an assembly of elevator rails that, during assembly, are put together to form a continuous elevator car rail, counterweight guide rail, or the like, can each be fastened using at least one fastening module. A common integral portion of an elevator rail is typically approximately 5 meters long. Each portion is generally fastened to a shaft wall by one to two fastening modules, or more fastening modules, and the portions are interconnected by connecting plates, thus producing a cohesive row of elevator rails. After the elevator system is assembled, an elevator car guide rail or a counterweight guide rail of this type results from an assembly of elevator rails that are arranged in succession along a longitudinal axis and are fastened in the elevator shaft or the like by a plurality of fastening modules.

In one solution, an elevator system comprising at least one assembly of elevator rails arranged in succession along a longitudinal axis and a plurality of fastening modules are proposed, the fastening modules being used to fasten the rail feet of the elevator rails.

In a proposed method for fastening a rail foot of an elevator rail, which is carried out using one or more fastening modules, the fastening module is mounted, or mounted in advance, on the shaft wall. The first side of the rail foot is inserted between a contact region and a support region of the first fastening device of the fastening module, and the second fastening device is rotated and moved such that the second side of the rail foot is arranged between a contact region and a support region of the second fastening device.

The fastening module is not necessarily securely mounted on a supporting structure, a shaft wall, or the like before the elevator rail is arranged on the fastening module. Nevertheless, it is advantageous for one or more fastening modules to be mounted, or at least mounted in advance, in the elevator shaft in a stationary manner. The elevator rail is then positioned on this one fastening module, or preferably on the plurality of fastening modules, such that the first side of said elevator rail is fitted on the first fastening device or on the first fastening devices of the plurality of fastening modules. Advantageously, the second fastening device, or the second fastening devices, of the plurality of fastening modules can then be positioned in the proposed manner. This results in an advantageous assembly option, which a technician can carry out easily and using fewer tools.

It is advantageous for the element of the second fastening device, which element, when assembled, interacts with the top side of the rail foot, to be a support element and for a support region of the support element, when assembled, to be arranged at a predetermined distance from the fastening plane. The top side of the rail foot can be oriented by means of the support region of the second fastening device and preferably by means of a support region of a support element of the first fastening device. As a result, the elevator rails, in particular tracks on a rail head of the elevator rail, are also oriented in the space.

It is also advantageous for the second fastening device to comprise a compensating means having a contact element, and for a contact region to be formed on the contact element, it being possible for a second side of the rail foot, when assembled, to be arranged between the contact region of the contact element and a support region of a support element of the second fastening device. Accordingly, a compensating means having a contact element can be provided on the first fastening device, a contact region also being formed on this contact element and it being possible for a first side of the rail foot, when assembled, to be arranged between the contact region of the contact element and a support region of a support element of the first fastening device. Specifically, an adjustment to different rail feet can be carried out here using the compensating means. Furthermore, the compensating means can make it possible to fasten the rail foot in a simple manner. In particular, the rail foot can be fastened without using any additional tools in this case. This means that a modular construction is possible. In particular, the fastening module can be manufactured in a manufacturing plant with respect to a particular rail type. It is particularly easy to assemble elevator rails of this rail type. Here, a certain level of tolerance compensation can be allowed, which in particular results from manufacturing-related deviations in rail feet of a rail type.

It is particularly advantageous here for the compensating means to be designed such that a holding dimension provided between the contact region and the support region can be adapted to a holding dimension required for the second side of the rail foot, in which the second side of the rail foot, when assembled, is held between the contact region and the support region. Accordingly, a compensating means for the first fastening device can be designed such that a holding dimension provided between the contact region and the support region can be adapted to a holding dimension required for the first side of the rail foot, in which the first side of the rail foot, when assembled, is held between the contact region and the support region. Variations in the required holding dimension may be tolerance-related, for example. This particularly relates to manufacturing tolerances between individual elevator rails of a particular rail type. Depending on the design of the fastening module, an adaptation to different rail types can however be made using a compensating means, if an adaptation thereto is possible and feasible.

It is also advantageous for the compensating means to comprise a wedge element, for the contact element and the wedge element to be adjustable relative to one another at least approximately in parallel with the fastening plane, and for the contact element and the wedge element to be designed such that, between the contact region and the support region, a holding dimension, which is viewed at least approximately perpendicularly to the fastening plane, can be changed. Here, the holding dimension can be changed such that it is made possible for the second side of the rail foot to be fastened without play when assembled, this being carried out by moving the contact element relative to the wedge element and/or by moving the contact element relative to the fastening plane. Accordingly, it is advantageous for the compensating means of the first fastening device to comprise a wedge element, and for the contact element and the wedge element of the first fastening device to be adjustable relative to one another at least approximately in parallel with the fastening plane. In this case, the compensating means and the wedge element of the first fastening device are advantageously designed such that, between the contact region and the support region, a holding dimension, which is viewed at least approximately perpendicularly to the fastening plane and in which it is made possible for the first side of the rail foot to be fastened without play when assembled, can be changed by moving the contact element relative to the wedge element of the first fastening device and/or by moving the contact element of the first fastening device relative to the fastening plane.

Here, due to its design, the wedge element can be held in a stationary manner in the adjustment direction of the contact element when the contact element is adjusted in order to mount the rail foot. This allows for simple handling by a technician. Furthermore, when the rail foot is in direct contact with the contact element due to the contact element potentially being fastened, the contact element is prevented from being moved out of position, for example when the rail foot moves.

It is also advantageous for it to be possible for at least the element of the second fastening device to be rotated by at least approximately 90° about the axis of rotation of the second fastening device, over the top side of the rail foot from laterally outside the rail foot. In particular, the second fastening device can be rotated about the axis of rotation as a whole. When the rail foot is in position, this makes it possible for the rail foot to be gripped, or encompassed. This means that the installation space required by the fastening module is optimized. Advantageously, the first fastening device cannot rotate in this way. This makes it easier to manufacture the fastening module, and also allows one or more first fastening devices of one or more fastening modules to be available, in order for the first side of the rail foot to be mounted therein to a certain extent. When the rail foot is positioned so as to have its first side on the at least one first fastening device at least of one fastening module, the assembly can be continued on the second side. At suitable points in time, on the first side and the second side of the rail foot, assembly steps can be carried out that hold and fasten the rail foot in that position, for example by means of appropriate compensating means.

Advantageously, a guide is provided by means of which the second fastening device is guided along a guide track in the fastening plane, the guide track comprising an advancing portion oriented such that the second fastening device can move at least substantially directly towards a predetermined assembly position of the second side of the rail foot. The predetermined assembly position is understood here to mean the position of the elevator rail that is reached, or is supposed to be reached, during the assembly. This may for example relate to the position and orientation of a top side of the rail foot and generally, accordingly, to the arrangement of tracks, formed on a rail head, in the elevator shaft. By means of the advancing portion of the guide track, it is first made possible, over a short section of the guide track, for the second fastening device to be brought close to the rail foot.

It is also advantageous for a guide to be provided by means of which the second fastening device is guided along a guide track in the fastening plane, and for the guide track to comprise an approach portion oriented such that the second fastening device can move both towards a predetermined assembly position of the second side of the rail foot and also in parallel with a longitudinal axis of the rail foot specified by the assembly position. By contrast with an advancing portion, which is preferably likewise provided, the approach to the rail foot is made and the second side of the rail foot is thus increasingly encompassed over a longer section of the guide track. This configuration can also make it easier to insert the rail foot between the first fastening device and the second fastening device. Therefore, the first fastening device is positioned so as to be substantially stationary relative to the fastening plane. This means that it cannot move and is preferably not rotatably arranged, either.

Specifically, it is advantageous for the guide track to have a first inclination that is at least approximately equal to 90° along the advancing portion and/or to have a second inclination that is always less than 45° along the approach portion relative to the longitudinal axis of the rail foot specified by the assembly position, when viewed in a projection onto the fastening plane. It is for example possible here for the second inclination to also vary in the approach portion. It is, however, also possible for the second inclination to be at least approximately constant along the approach portion. The guide track extends at least approximately in a straight line in the approach portion. Advantageously, the guide track may comprise a bend between the advancing portion and the approach portion. This makes it easier to design the guide, and this can also predetermine straight-line movements of the second fastening element along the guide track during assembly. In a modified embodiment, however, a for example curved transition between the advancing portion and the approach portion can also be provided. The dimensions of the required fastening can thus be optimized.

In an advantageous embodiment, a base plate is provided, on which the fastening plane is located, at least indirectly. In this case, this base plate may be designed to be bent in an L shape, it being possible for the fastening plane to be provided on one leg, and one or more options for fastening to a supporting structure or the like being provided on the other leg. A guide for the second fastening device may be made in the base plate, advantageously in the form of a guide cut-out.

It is also advantageous here for the guide cut-out made in the base plate to comprise a slot with or without rounded transitional portions. A fastening means of the second fastening device can for example extend through a slot of this type, and can interact with the guide cut-out for the purpose of guidance. By means of the base plate bent in an L shape, the fastening module can be easily fastened to the shaft wall. Holes being accordingly arranged in the part of the base plate that is curved upwards make it possible adjust the fastening on the shaft wall, such that the entirety of the elevator guide rail can be oriented in a straight line after having been fastened to the fastening module.

In an advantageous embodiment, the slot is designed to have a bend along the guide track. Additionally or alternatively, it is advantageous for the slot to be at least approximately made up of at least two rectangular shapes turned relative to one another. These rectangular shapes are oriented in parallel with the fastening plane and are turned relative to one another. As a result, an advancing portion and an approach portion can be produced according to the two rectangular shapes.

DESCRIPTION OF THE DRAWINGS

Preferred embodiments of the invention are explained in greater detail in the description below on the basis of the accompanying drawings, in which identically operating parts across the drawings are denoted by identical reference numerals. In the drawings.

DETAILED DESCRIPTION

Figure 1:
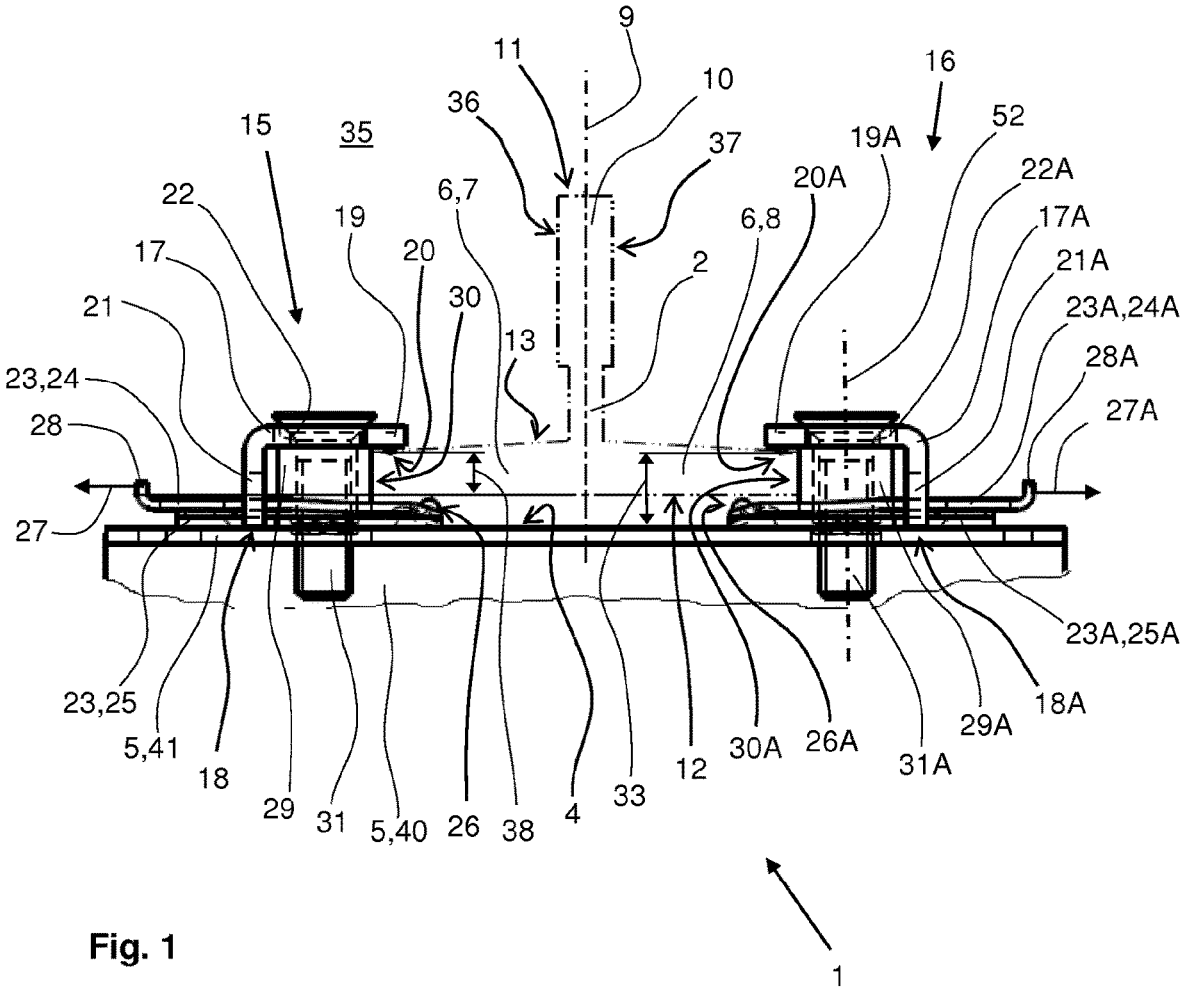
FIG. 1 is a partial schematic view of a fastening module used for fastening a rail foot of an elevator rail, according to an embodiment of the invention.

FIG. 1 is a partial schematic view of a fastening module 1 and an elevator rail 2 of an elevator system according to an embodiment of the invention, the fastening module 1 being used to fasten the elevator rail 2 to a fastening plane 4. The fastening plane 4 is formed on a base plate 5 bent in an L shape in this case. In this embodiment, the fastening plane 4 lines up with a side of the base plate 5 facing the rail foot 6 of the elevator rail 2 when the elevator rail 2 is fastened to the fastening plane 4 by the fastening module 1.

The rail foot 6 has a first side 7 and a second side 8. The selection of the first side 7 and the second side 8 with respect to an axis 9 of the elevator rail 2 is arbitrary here, and in a modified embodiment the sides 7, 8 can be accordingly swapped.

Furthermore, the elevator rail 2 comprises a rail head 10 having an end face 11. The lower side 12 of the rail foot 6 facing the fastening plane 4 or the side 4 of the base plate 5 faces away from the end face 11 of the rail head 10. Furthermore, the rail foot 6 has a top side 13 that extends over the two sides 7, 8 and faces away from the lower side 12 of the rail foot 6, and from the fastening plane 4 when assembled.

The fastening module 1 comprises a first fastening device 15 and a second fastening device 16. The first fastening device 15 is used to fasten the first side 7 of the rail foot 6 to the fastening plane 4. The second fastening device 16 is used to fasten the second side 8 of the rail foot 6 to the fastening plane 4. In this embodiment, the first fastening device 15 and the second fastening device 16 are in mirror symmetry with the axis 9 in terms of their construction when assembled. However, the difference is that the first fastening device 15 is arranged on the base plate 5 so as to be stationary relative to the fastening plane 4, at least in parts, during assembly, while the second fastening device 16 is arranged on the base plate 5 so as to be rotatable and movable relative to the fastening plane 4 during assembly. In a modified embodiment in which the sides 7, 8 are swapped, the fastening devices 15, 16 are also accordingly swapped.

The first fastening device 15 contains an L-shaped support element 17, the end face 18 of which defines a fastening plane 4. A support region 20, which is in the form of a projection 20 in this embodiment, is formed on a part 19 of the support element 17. The support element 17 also comprises a clearance 21. Another clearance 22 in the support element 17 is designed as a hole 22.

The first fastening device 15 also comprises a compensating means 23, which comprises elements 24, 25 in this embodiment. In this embodiment, the element 24 is designed as a contact element 24. The element 25 is designed as a wedge element 25. A contact region 26 in the form of a projection 26 is formed on the contact element 24. An adjustment direction 27 oriented in parallel with the fastening plane 4 is predetermined for the contact element 24. Furthermore, an adjustment tab 28, by means of which a technician can adjust the contact element 24 in the adjustment direction 27, is formed on the contact element 24. The contact elements 24, 25 extend through the clearance 21 in the support element 17. In this embodiment, the wedge element 25 is arranged so as to be stationary relative to the fastening plane 4, while the contact element 24 can be adjusted in the adjustment direction 27.

In addition, the first fastening device 15 comprises a sleeve 29, which may be annularly closed or open over its periphery. The support element 17 is not only supported on the fastening plane 4 or the base plate 5 by the end face 18, but is also supported on the fastening plane 4 or the base plate 5 by the sleeve 29. There is also a lateral support region 30 for the rail foot 6 on the sleeve 29.

In a modification, the wedge element 25 may also be fastened directly to the fastening plane 4 by the sleeve 29. The height of the sleeve 29 is reduced by the thickness of the wedge element 25 in this case.

The first fastening device 15 also comprises a fastening means 31, which for example allows screws to be used for fastening to the base plate 5. Using the fastening means 31, the support element 17 is securely fastened to the base plate together with the sleeve 29 and preferably the wedge element 25 positioned thereunder.

Accordingly, the second fastening device 16 comprises a support element 17A, on which an end face 18A is formed. A support region 20A in the form of a projection 20A is formed on a part 19A of the support element 17A. A clearance 21A and a clearance 22A in the form of a hole 22A are also formed on the support element 17A. Furthermore, the second fastening device 16 comprises a compensating means 23A comprising elements 24A, 25A. The element 24A is designed as a contact element 24A. The element 25A is designed as a wedge element 25A. Furthermore, a contact region 26A in the form of a projection 26A is formed on the element 24A. An adjustment direction 27A is predetermined for the contact element 24A. Here, an adjustment tab 28A is formed on the contact element 24A. Furthermore, the second fastening device 16 comprises a sleeve 29A. A support region 30A is produced on the sleeve 29A. The wedge element 25A is also sometimes positioned under the sleeve 29A. In addition, the second fastening device 16 comprises a fastening means 31A.

It is clear that properties and modes of operation that are described in relation to one of the fastening devices 15, 16 can also be transferred at least in part to the other fastening device 15, 16 in each case.

When assembled, the top side 13 of the rail foot 6 is in contact with the support region 20 of the first fastening device 15 on one side and with the support region 20A of the second fastening device 16 on the other side. This sets the orientation of the elevator rail 2 in an elevator shaft 35. As a result, tracks 36, 37 formed on the rail head 10 are also set in terms of their extension through the elevator shaft 35. Depending on the design, another fastening module corresponding to the fastening module 1 may also be required here in order to set the position of the elevator rail 2 in the elevator shaft 35. One or more fastening modules 1 may be provided on an elevator rail 2.

In the assembled state in which the elevator rail 2 is fastened to the fastening plane 4 by the fastening module 1, the contact regions 26, 26A of the contact elements 24, 24A are also in contact with the lower side 12 of the rail foot 6. In so doing, there is a kind of clamping grip between the contact region 26 and the support region 20, and between the contact region 26A and the support region 20A, respectively, in which the first side 7 and the second side 8, respectively, of the rail foot 6 are gripped.

A holding dimension 38 is produced between the contact region 26 and the support region 20, perpendicularly to the fastening plane 4. This holding dimension 38 reduces due to the wedge shape of the wedge element 25 when the contact element 24 is adjusted in the adjustment direction 27. In the assembled state, the holding dimension 38 is equal to the required holding dimension 38 which is determined by the geometry of the rail foot 6. In this embodiment, the same holding dimension 38 is also produced at the second fastening device 16. In principle, however, different holding dimensions 38 may also be produced at the fastening devices 15, 16. Generally, the required holding dimension 38, which is dependent on the relevant rail foot, varies from one elevator rail 2 to another elevator rail 2 due to manufacturing tolerances. Using the described adaptation mechanism, the holding dimension 38 can be set to the required holding dimension 38 in each case.

In this embodiment, spacing 33 between the support region 20A, 20 of the support element 17, 17A and the fastening plane 4 is fixed in the assembled state. The holding dimension 38 can be set during assembly of the elevator rail 2 by means of the compensating means 23, 23A.

Figure 2:
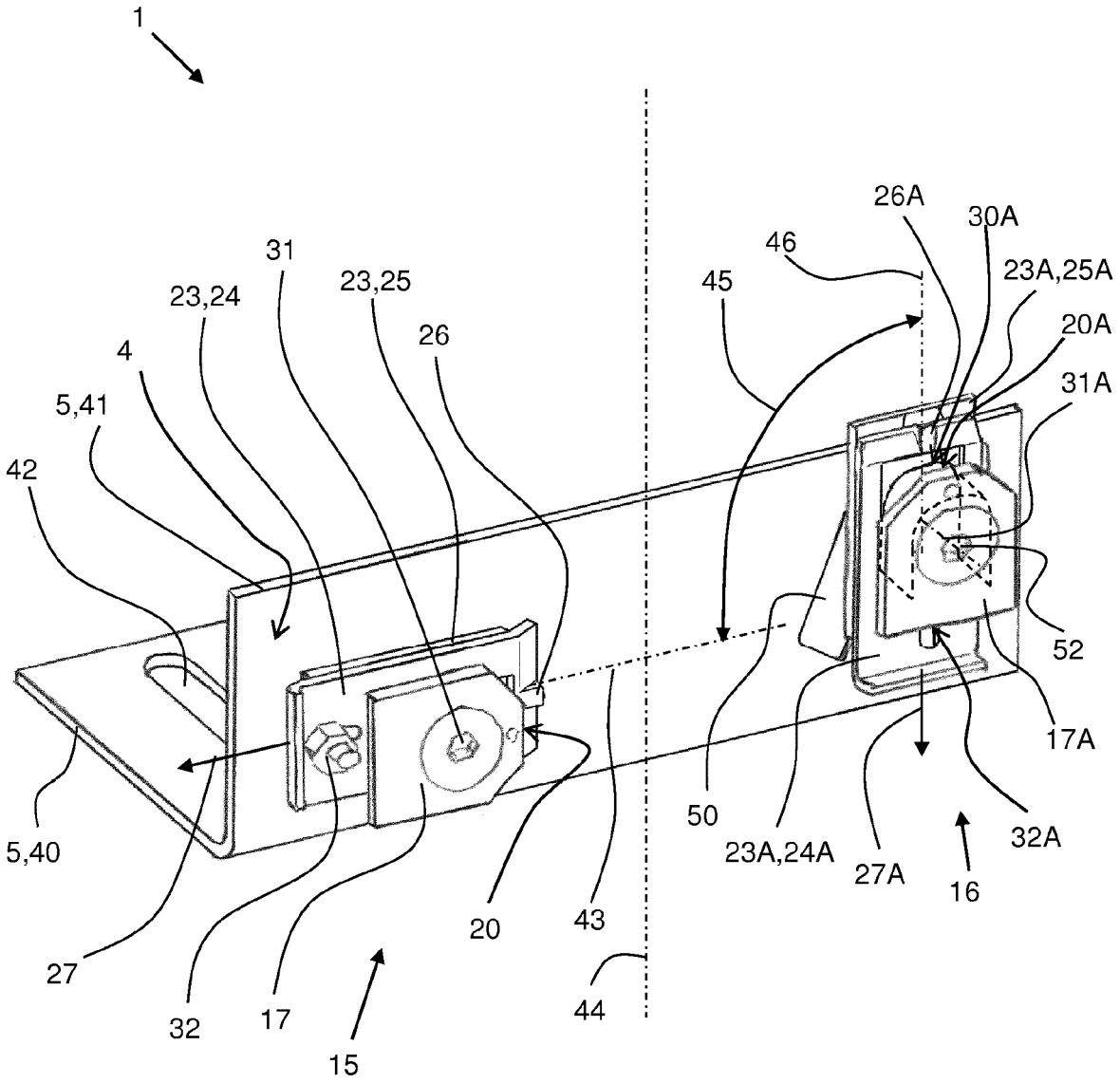
FIG. 2 is a three-dimensional view of the fastening module shown in FIG. 1, according to the embodiment, in a position prepared for assembly.

FIG. 2 is a three-dimensional view of the fastening module 1 shown in FIG. 1, according to the embodiment, in a position prepared for assembly. The fastening module 1 can be preassembled at the manufacturing plant in this form. Other parts, which are used for example for fastening the module to a shaft wall, are sometimes included or preassembled if necessary. The base plate 5, which is bent in an L shape in this embodiment, comprises legs 40, 41. Here, suitable assembly options 42 in the form of slots 42 or the like are provided on the leg 40. As a result, it is possible to screw this to the supporting structure. FIG. 2 shows an axis 43 and a longitudinal axis 44. In this case, the longitudinal axis 44 is the axis along which the assembled elevator rail 2 extends. The longitudinal axis 44 is substantially parallel to the fastening plane 4, which includes the case in which the longitudinal axis 44 lies in the fastening plane 4. In addition, the axis 43 is oriented in parallel with the fastening plane 4 and perpendicularly to the longitudinal axis 44. In the prepared position, the first fastening device 15 is oriented relative to the axis 43 such that the adjustment direction 27 is parallel to the axis 43. The first fastening device 15 is connected to the base plate 5 by the fastening means 31 in this case, and no rotation or movement is possible. When the locking means 32 is loose, the contact element 24 can nevertheless be adjusted in the adjustment direction 27. When the locking means 32 is tightened, the contact element 24 is also locked.

In the prepared position, the second fastening device 16 is, however, oriented along the longitudinal axis 44 such that the relevant adjustment direction 27A is parallel to the longitudinal axis 44. This means that an angle 45 between an axis 46 in the adjustment direction 27A and the axis 43 is at least approximately equal to 90°. During preassembly, the angle 45 of approximately 90° is not a predetermined value. Instead, the fastening device 16 is loose, i.e. is mounted so as to be movable on the fastening plane 4.

It is clear that a locking means 32A (FIG. 4) is also provided for the second fastening device 16. A locking means 32A of this type may also be mounted at a later point in time if necessary. However, a locking means 32A of this type can also be mounted on the second fastening device 16 in advance in the fastening module 1 that is prepared for assembly.

Figure 3:
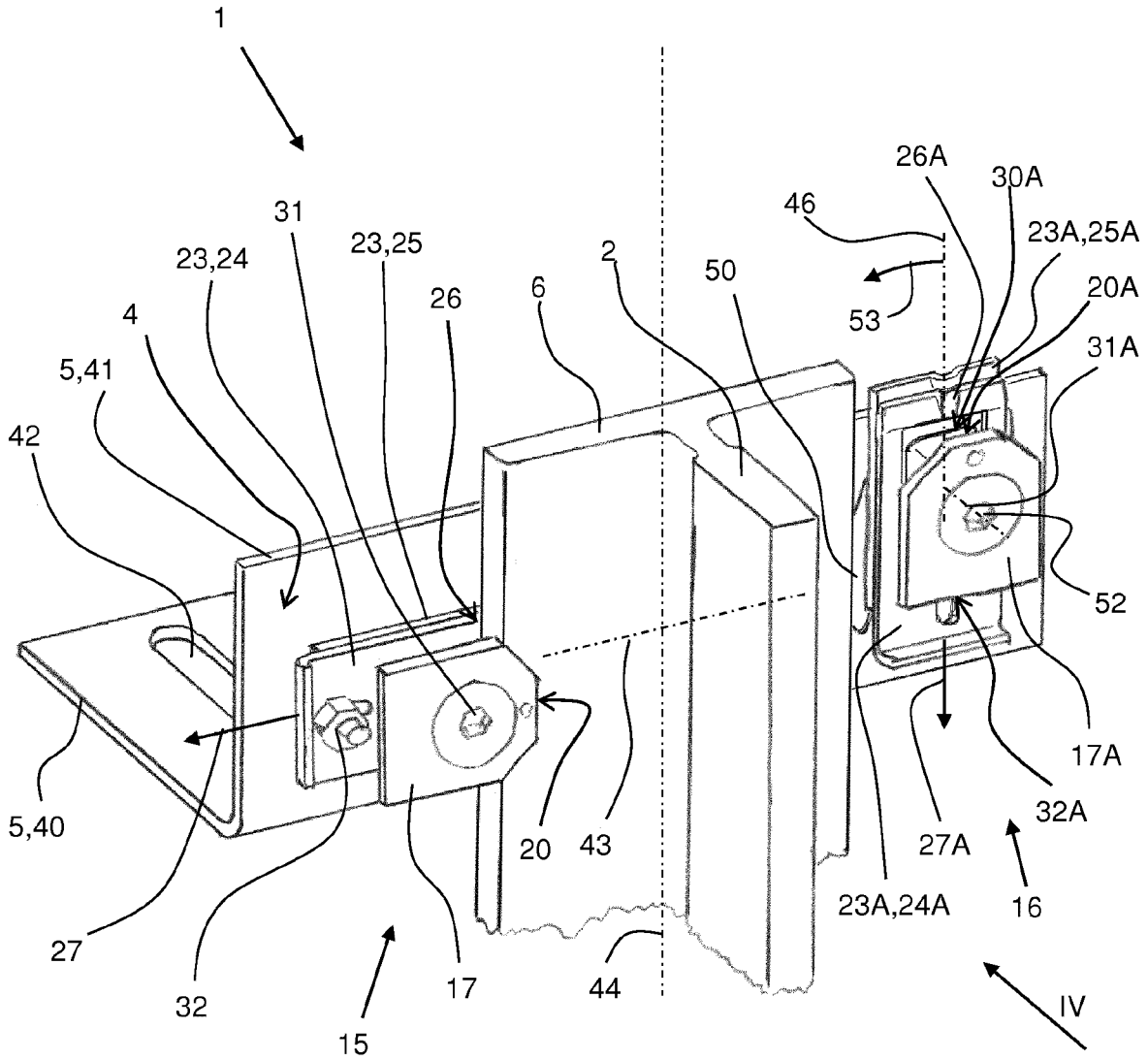
FIG. 3 shows the fastening module shown in FIG. 2 and an elevator rail during assembly.

FIG. 3 shows the fastening module 1 shown in FIG. 2 and the elevator rail 2 during assembly. Here, the elevator rail 2 is inserted between the fastening devices 15, 16. Owing to the position of the second fastening device 16 rotated by 90° and to a certain amount of spacing, the rail foot 6 can be inserted into the position shown without disassembling the first fastening device 15. The first side 7 of the rail foot 6 can be slid into the clamps between the support region 20 and the contact region 26 of the first fastening device 15 to a certain extent in the adjustment direction 27 or along the axis 43, such that the first side 7 of the elevator rail 2 is contact with the support region 30 of the support element 17.

The second fastening device 16 initially remains loose in the prepared position, as also shown in FIG. 2.

Figure 4:
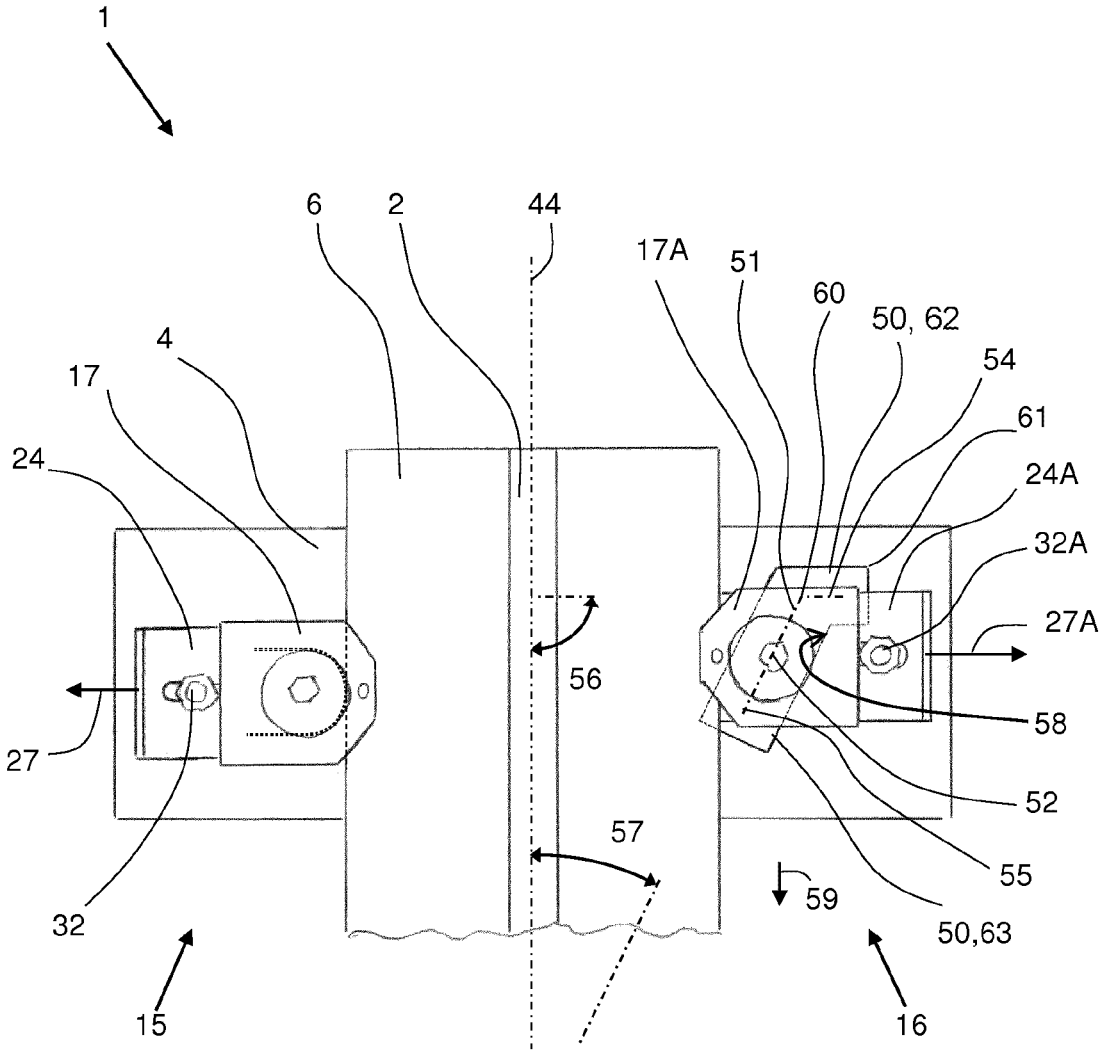
FIG. 4 is a schematic view of the fastening module shown in FIG. 3 and the elevator rail from the viewing direction denoted IV, when assembled.

FIG. 4 is a schematic view of the fastening module 1 shown in FIG. 3 and the elevator rail 2 from the viewing direction denoted IV, when assembled. The base plate 5 comprises a guide cut-out 50 in the form of a slot 50, by means of which a guide 50 is formed. A guide track 51 is formed by the geometry of the guide cut-out 50 and the interaction with the fastening means 31A. The second fastening device 16 can be moved along the guide track 51 relative to the fastening plane 4. In addition, it is possible for the second fastening device 16 to rotate about an axis of rotation 52, which coincides with the axis 52 of the fastening means 31A in this embodiment. The axis of rotation 52 is oriented perpendicularly to the fastening plane 4.

In a possible assembly step, proceeding from the position shown in FIG. 3, the second fastening device 16 initially rotates about the axis of rotation 52. Here, the second fastening device 16 can be rotated in a rotational direction 53 (FIG. 3). At the same time, the second fastening device 16 can be adjusted along the guide track 51. In this embodiment, the guide track 51 comprises an advancing portion 54 and an approach portion 55. In relation to a projection of the longitudinal axis 44 and the advancing portion 54 into the fastening plane 4, a first inclination (angle) 56 of approximately 90° is produced therebetween in this embodiment, at least approximately. Accordingly, in a projection into the fastening plane 4, a second inclination (angle) 57 of the approach portion 55 relative to the longitudinal axis 44 is produced, which, in this embodiment, is significantly less than 90° and even less than 45°. Over the advancing portion 54, the second fastening device approaches so as to be very close to the second side 8 over a short adjustment path. Then, over the approach portion 55, a slower approach can be achieved in relation to the adjustment path along the guide track 51. Here, support of the second fastening device 16 on a side 58 of the guide cut-out 50 can also be utilized. In particular, assembly is simplified by the second fastening device 16 being supported on the side 58 by means of the fastening means 31A when the technician urges the second fastening device 16 in a direction 59 parallel to the longitudinal axis 44. By means of this advancing movement, the second side 8 of the rail foot 6 comes to be between the contact region 26A and the support region 20A of the second fastening device 16. Here, the second fastening device 16 can rotate by 90° in the rotational direction 53 right at the start. By advancing the fastening device 16 along the guide track 51 towards the elevator rail 2, the support region 30A of the support element 17A is advanced towards the second side 8 of the elevator rail 2 until the support region 30A is in loose contact with the second side 8. As a result, the elevator rail 2 is laterally guided.

In particular, the support element 17A can therefore be rotated over the top side 13 of the rail foot 6 from laterally outside the rail foot 6, as shown in FIG. 3. The rail foot 6 can thus be fastened between the lateral support regions 30, 30A of the fastening devices 15, 16 shown in FIG. 1 as desired and with as little play as possible, in a simple manner, after the fastening means 31, 31A has been tightened.

In a possible assembly process, the technician can adjust the contact elements 24, 24A in the respective adjustment directions 27, 27A thereof after tightening the fastening means 31A. Locking can then be carried out using the locking means 32, 32A. The rail foot 6 is then fastened to the fastening plane 4 by the fastening module 1.

This fastening allows a certain amount of length compensation or movement of the elevator rail 2 along its longitudinal axis 44 relative to the fastening module 1. The holding forces applied by the fastening devices 15, 16 can specifically be proportioned such that, for example, length changes occurring due to the building settling can be compensated for. Here, the elevator rail 2 is permitted to slip through the fastening module 1 to a certain extent.

In this embodiment, the guide track 51 comprises a bend 60. In a modified embodiment, the guide cut-out 50 may however also be bent, meaning that a bend 60 of this kind is omitted. In addition, in this embodiment, the guide cut-out 50 comprises edges 61, of which only the one edge 61 is marked in order to simplify the figure. By means of appropriate rounding, one or more edges 61 of this type can be omitted, or the edges 61 are then replaced by rounded transitional portions.

In this embodiment, the guide cut-out 50 is made up of two rectangles 62, 63. In this case, the rectangles 62, 63 are oriented in parallel with the fastening plane 4 and are turned relative to one another in relation to the fastening plane 4. This turning is demonstrated by the different inclinations 56, 57.

Figure 5:
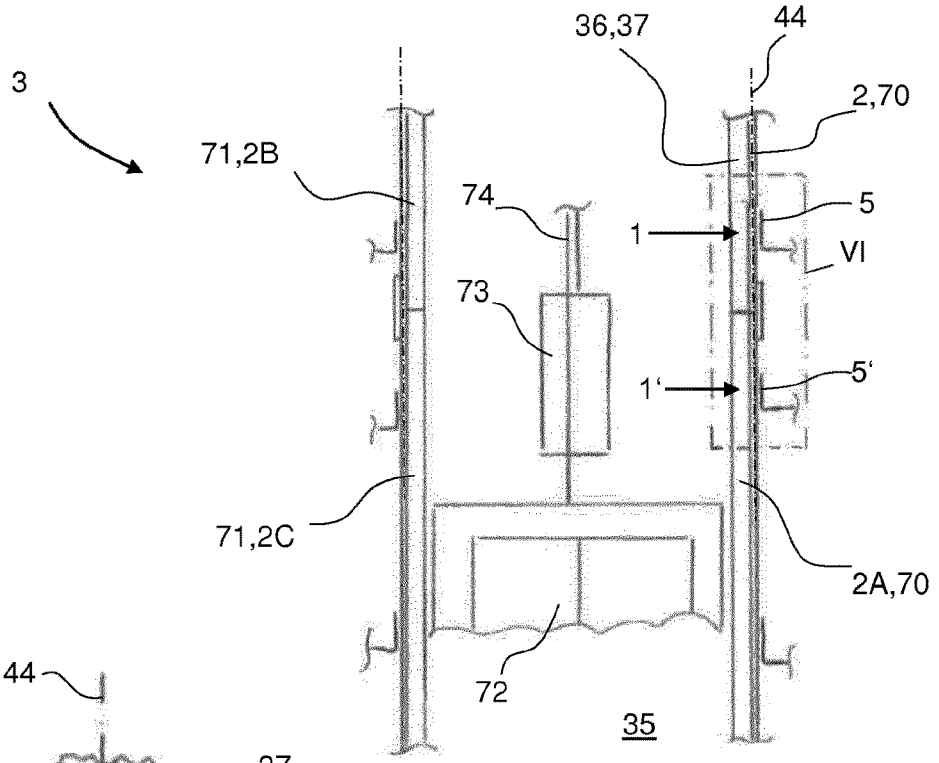
FIG. 5 is a partial schematic view of an elevator system according to a possible embodiment of the invention.

FIG. 5 is a partial schematic view of an elevator system 3 according to a possible embodiment of the invention. The elevator system 3 comprises a plurality of elevator rails 2, 2A, 2B, 2C. Here, the elevator rails 2, 2A are part of an assembly 70 of a plurality of elevator rails 2, 2A that extend through the elevator shaft 35, along the longitudinal axis 44. The elevator rails 2B, 2C are part of another such assembly 71 of a plurality of elevator rails 2B, 2C. Braking and/or guide tracks 36, 37 are produced on the assembly 70, for example, which extend at least substantially through the entire elevator shaft 35. Tracks 36, 37 of this type continue over the individual elevator rails 2, 2A.

The elevator system 3 also comprises an elevator car 72 and a counterweight 73, which are interconnected by a support and traction means 74. By means of the assemblies 70, 71 and possibly other assemblies of this kind, the elevator car 72 and the counterweight 73 can be guided in the elevator shaft 35, inter alia.

Figure 6:
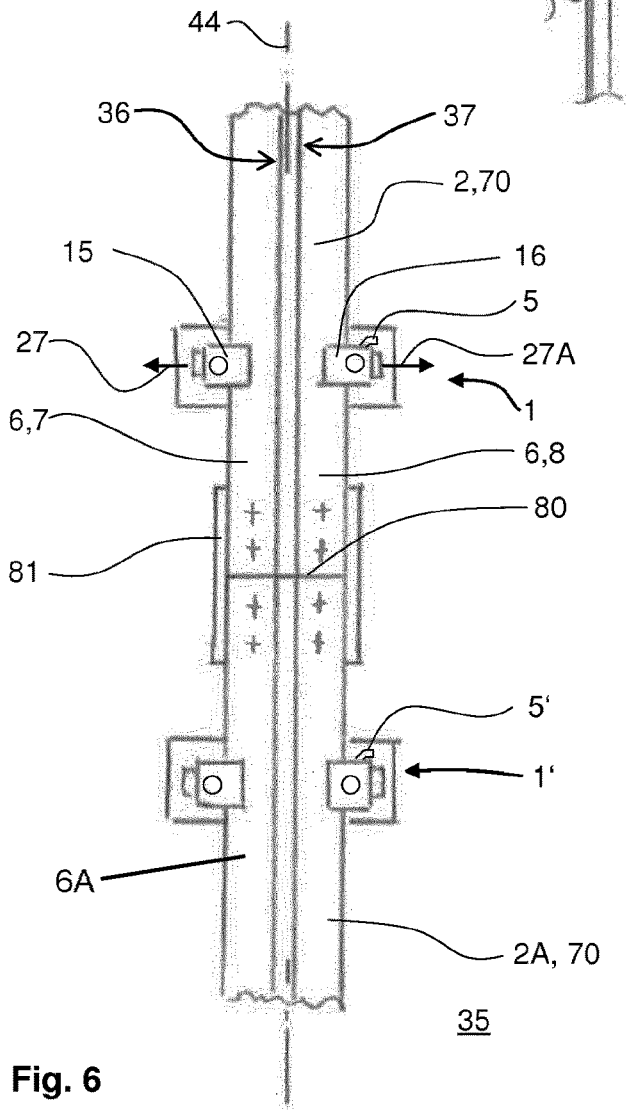
FIG. 6 shows a detail, denoted VI in FIG. 5, of an assembly of elevator rails to explain a possible embodiment of the invention.

FIG. 6 shows the detail, denoted VI in FIG. 5, of the elevator system 3 together with the assembly 70 and fastening modules 1, 1'. The fastening modules 1, 1' comprise base plates 5, 5' that are mounted in the elevator shaft 35 by means of a supporting structure or the like. The elevator rails 2, 2A are butt-joined to one another at an interface 80. The elevator rails 2, 2A can be joined together by means of connecting plates 81 at the interface 80, for example. As a result, the continuous tracks 36, 37 are produced on the assembly 70 of a plurality of elevator rails 2, 2A.

The rail feet 6, 6A of the elevator rails 2, 2A may differ on account of manufacturing tolerances, for example. This may be apparent from different required holding dimensions 38. Nevertheless, identical fastening modules 1, 1' can be used to assemble the elevator rails 2, 2A. Each holding dimension 38 can be set to the required holding dimension 38, as described with reference to FIG. 1, in a customized manner on each individual fastening module 1, 1' during assembly.

The invention is not limited to the described embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A fastening module for fastening a rail foot of an elevator rail to a fastening plane, comprising:

a first fastening device that, when fastened to the fastening plane, holds a first side of the rail foot;

a second fastening device that, when fastened to the fastening plane, holds a second side of the rail foot, the second fastening device being moveable in parallel to the fastening plane and including a support element that interacts with a top side of the rail foot facing away from the fastening plane, the second fastening device being rotatable about an axis of rotation perpendicular to the fastening plane over the top side of the rail foot from a position laterally outside of the rail foot; and a guide by which the second fastening device is guided along a guide track in the fastening plane, the guide track including a first inclination and a second inclination in relation to a longitudinal axis of the rail foot when viewed in a projection onto the fastening plane, wherein the first inclination is different from the second inclination, the guide track including an advancing portion oriented at the first inclination to permit the second fastening device to move towards a predetermined assembly position of the second side of the rail foot, and wherein the guide track includes an approach portion oriented at the second inclination to permit the second fastening device to move at an angle of inclination both towards and along the longitudinal axis of the rail foot.

2. The fastening module according to claim 1 wherein the guide track has a bend between the advancing portion and the approach portion.

3. The fastening module according to claim 1 wherein the guide track has a bend between the first inclination and the second inclination.

4. The fastening module according to claim 1 wherein at least one of the second inclination is less than 45° and the first inclination is approximately equal to 90°.

5. The fastening module according to claim 1 including a base plate on which the fastening plane is positioned and wherein the guide is integrated in the base plate.

6. The fastening module according to claim 5 wherein the base plate has a guide cut-out formed as a slot, the slot having at least one of:

rounding at edges of the slot;

a bend along the guide track; and at least two rectangular shapes turned relative to one another.

7. The fastening module according to claim 1 wherein the first fastening device is stationary on the fastening plane.

8. The fastening module according to claim 1 wherein the support element of the second fastening device has a support region arranged at a predetermined distance from the fastening plane.

9. The fastening module according to claim 1 wherein the second fastening device includes a compensating means having a contact element with a contact region formed thereon, and wherein a second side of the rail foot is arranged between the contact region and a support region of the support element.

10. The fastening module according to claim 9 wherein the compensating means adapts a holding dimension between the contact region and the support region to a required holding dimension for the second side of the rail foot to hold the second side of the rail foot between the contact region and the support region.

11. The fastening module according to claim 9 wherein the compensating means includes a wedge element, the contact element and the wedge element being adjustable relative to one another in parallel with the fastening plane, wherein the contact element and the wedge element can be adjusted such that, between the contact region and the support region, a holding dimension viewed perpendicularly to the fastening plane can be changed by moving at least one of the contact element and the wedge element to fasten the second side of the rail foot without play.

12. The fastening module according to claim 1 wherein the support element of the second fastening device can be rotated by approximately 90° about the axis of rotation of the second fastening device over the top side of the rail foot from laterally outside the rail foot.

13. An elevator system comprising:

at least one assembly of elevator rails arranged in succession along a longitudinal axis; and a plurality of the fastening module according to claim 1 fastening rail feet of the elevator rails in an elevator shaft.

14. A method for fastening a rail foot of an elevator rail with at least one of the fastening module according to claim 1, comprising the steps of:

inserting a first side of the rail foot between a contact region and a support region of the first fastening device; and rotating and moving the second fastening device to arrange the second side of the rail foot between a contact region and a support region of the second fastening device.

15. A fastening module for fastening a rail foot of an elevator rail to a fastening plane, comprising:

a first fastening device that, when fastened to the fastening plane, holds a first side of the rail foot;

a second fastening device that, when fastened to the fastening plane, holds a second side of the rail foot, the second fastening device being moveable in parallel to the fastening plane and including a support element that interacts with a top side of the rail foot facing away from the fastening plane, the second fastening device being rotatable about an axis of rotation perpendicular to the fastening plane over the top side of the rail foot from a position laterally outside of the rail foot;

a guide by which the second fastening device is guided along a guide track in the fastening plane, the guide track including an advancing portion oriented to permit the second fastening device to move towards a predetermined assembly position of the second side of the rail foot, and the guide track including a first inclination and a second inclination in relation to a longitudinal axis of the rail foot when viewed in a projection onto the fastening plane;

wherein the second fastening device includes a compensating means having a contact element with a contact region formed thereon, and wherein a second side of the rail foot is arranged between the contact region and a support region of the support element; and wherein the compensating means includes a wedge element, the contact element and the wedge element being adjustable relative to one another in parallel with the fastening plane, wherein the contact element and the wedge element can be adjusted such that, between the contact region and the support region, a holding dimension viewed perpendicularly to the fastening plane can be changed by moving at least one of the contact element and the wedge element to fasten the second side of the rail foot without play.

16. A fastening module for fastening a rail foot of an elevator rail to a fastening plane, comprising:

a first fastening device that, when fastened to the fastening plane, holds a first side of the rail foot;

a second fastening device that, when fastened to the fastening plane, holds a second side of the rail foot, the second fastening device being moveable in parallel to the fastening plane and including a support element that interacts with a top side of the rail foot facing away from the fastening plane, the second fastening device being rotatable about an axis of rotation perpendicular to the fastening plane over the top side of the rail foot from a position laterally outside of the rail foot;

a guide by which the second fastening device is guided along a guide track in the fastening plane, the guide track oriented to permit the second fastening device to move towards a predetermined assembly position of the second side of the rail foot; and wherein the guide track includes an advancing portion and an approach portion, the advancing portion being orientated at a first inclination angle transverse to a longitudinal axis of the rail foot when viewed in a projection onto the fastening plane and the approach portion being oriented at a second inclination angle in relation to the longitudinal axis wherein the approach portion permits the second fastening device to move both towards and along the longitudinal axis of the rail foot and the approach portion extends to the predetermined assembly position, wherein the first inclination angle is different from the second inclination angle.

* * * * *